US006554607B1

(12) United States Patent
Glezer et al.

(10) Patent No.: US 6,554,607 B1
(45) Date of Patent: Apr. 29, 2003

(54) COMBUSTION-DRIVEN JET ACTUATOR

(75) Inventors: Ari Glezer, Atlanta, GA (US); Thomas M. Crittenden, Smyrna, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 0 days.

(21) Appl. No.: 09/654,559

(22) Filed: Sep. 1, 2000

Related U.S. Application Data

(60) Provisional application No. 60/151,963, filed on Sep. 1, 1999.

(51) Int. Cl.[7] ..... F23C 11/04

(52) U.S. Cl. ..... 431/1; 431/12; 60/39.06; 60/39.76; 122/24

(58) Field of Search ..... 431/1, 12, 75, 431/173; 60/39.76, 39.77, 39.78, 39.8, 39.06; 122/24; 432/58

(56) References Cited

U.S. PATENT DOCUMENTS

| | | | | |
|---|---|---|---|---|
| 1,485,715 | A | 3/1924 | Robinson | |
| 1,878,088 | A | 9/1932 | Zwikker | |
| 2,498,990 | A | 2/1950 | Fryklund | 259/72 |
| 2,591,083 | A | 4/1952 | Maier | 51/2 |
| 2,761,833 | A | 9/1956 | Ward | 210/24 |
| 2,812,636 | A | 11/1957 | Kadosch | 60/35.55 |
| 3,058,014 | A | 10/1962 | Camp | 310/8.7 |
| 3,262,658 | A | 7/1966 | Reilly | 244/42 |
| 3,361,067 | A | 1/1968 | Webb | 103/1 |
| 3,425,058 | A | 1/1969 | Babington | 239/124 |
| 3,985,344 | A | 10/1976 | McCord | 259/1 |
| 4,131,505 | A | 12/1978 | Davis, Jr. | 156/580.1 |
| 4,171,852 | A | 10/1979 | Haentjens | 406/85 |
| 4,206,831 | A | 6/1980 | Welch et al. | 181/159 |
| 4,363,991 | A | 12/1982 | Edelman | 310/316 |
| 4,369,857 | A | 1/1983 | Frazer et al. | 181/159 |

(List continued on next page.)

FOREIGN PATENT DOCUMENTS

| | | | | |
|---|---|---|---|---|
| DE | 3320481 | | 12/1984 | |
| JP | 4-103494 | | 11/1967 | |
| JP | 2000-171005 | * | 6/2000 | 431/1 |
| SU | 590503 | | 11/1974 | |

OTHER PUBLICATIONS

Coe, et al., "Addressable Micromachined Jet Arrays," *The 8th International Conference of Solid–State Sensors and Actuators, and Eurosensors IX*, Jun. 25–29, 1995, pp. 329–332.

Ingard et al., "Acoustic Circulation Effects and the Nonlinear Impedance of Orifices," *The Journal of Acoustical Society of America*, vol. 22, No. 2, Mar. 1950, pp. 211–218.

Mednikov et al., "Experimental Study of Intense Acoustic Streaming," *Sov. Phys. Acoust.*, vol. 21, No. 2 Mar.–Apr. 1975, pp. 152–154.

Willmes, et al., "Low–Power Helium Pulsed Arcjet," Journal of Propulsion and Power, vol. 15, No. 3, May–Jun. 1999, pp. 440–446.

Hassan et al., "Effects of Zero–Mass 'Synthetic' Jets on the Aerodynamics of the NACA–0012 Airfoil," American Institute of Aeronautics and Astronautics, pp. 1–11.

* cited by examiner

*Primary Examiner*—James C. Yeung
(74) *Attorney, Agent, or Firm*—Thomas, Kayden, Horstemeyer & Risley

(57) ABSTRACT

The present disclosure relates to a flow control system, comprising a controller, an ignition device whose activation is controlled by the controller, a combustion-driven jet actuator, and a fuel source in fluid communication with the jet actuator that supplies fuel to the jet actuator. Typically, the jet actuator comprises a combustion chamber, an orifice that serves as an outlet for combustion products emitted from the combustion chamber, and at least one inlet through which fuel is supplied to the chamber for combustion. In use, the combustion-based jet actuator can emit jets of fluid at predetermined frequencies.

43 Claims, 8 Drawing Sheets

U.S. PATENT DOCUMENTS

| | | | | | |
|---|---|---|---|---|---|
| 4,465,234 | A | | 8/1984 | Maehara et al. | 239/102 |
| 4,473,185 | A | | 9/1984 | Peterson et al. | 239/8 |
| 4,516,747 | A | | 5/1985 | Lurz | 244/204 |
| 4,533,082 | A | | 8/1985 | Maehara et al. | 239/102 |
| 4,533,255 | A | | 8/1985 | Gronholz et al. | 366/108 |
| 4,548,240 | A | | 10/1985 | Graham | 138/30 |
| 4,568,265 | A | | 2/1986 | Firey | 431/1 |
| 4,583,936 | A | * | 4/1986 | Krieger | 431/1 |
| 4,611,553 | A | | 9/1986 | Iwata | 118/50 |
| 4,635,749 | A | | 1/1987 | Tattersall | 181/152 |
| 4,639,208 | A | * | 1/1987 | Inui et al. | 431/1 |
| 4,646,945 | A | | 3/1987 | Steiner et al. | 222/207 |
| 4,667,877 | A | | 5/1987 | Yao et al. | 239/102.2 |
| 4,671,056 | A | * | 6/1987 | Genz et al. | 431/1 |
| 4,693,201 | A | | 9/1987 | Williams et al. | 114/67 R |
| 4,697,769 | A | | 10/1987 | Blackwelder et al. | 244/199 |
| 4,702,418 | A | | 10/1987 | Cater et al. | 239/101 |
| 4,747,523 | A | | 5/1988 | Dobbs | 222/383 |
| 4,798,190 | A | | 1/1989 | Vaznaian et al. | 123/531 |
| 4,802,642 | A | | 2/1989 | Mangiarotty | 244/200 |
| 4,846,149 | A | * | 7/1989 | Chato | 431/1 |
| 4,930,701 | A | | 6/1990 | Porter et al. | 239/102.2 |
| 4,957,783 | A | | 9/1990 | Gabryszewski | 427/424 |
| 5,040,560 | A | | 8/1991 | Glezer et al. | 137/13 |
| 5,052,917 | A | * | 10/1991 | Saito et al. | 431/1 |
| 5,090,891 | A | * | 2/1992 | Hemsath | 431/1 |
| 5,119,840 | A | | 6/1992 | Shibata | 134/184 |
| 5,121,463 | A | | 6/1992 | Yoshihara | 392/379 |
| 5,123,835 | A | * | 6/1992 | Richards et al. | 431/1 |
| 5,199,856 | A | | 4/1993 | Epstein et al. | 417/312 |
| 5,203,362 | A | | 4/1993 | Shibata | 134/184 |
| 5,238,153 | A | | 8/1993 | Castillo et al. | 222/189 |
| 5,242,294 | A | * | 9/1993 | Chato | 431/1 |
| 5,346,745 | A | | 9/1994 | Bandyopadhyay | 428/156 |
| 5,365,490 | A | | 11/1994 | Katz | 367/1 |
| 5,395,592 | A | | 3/1995 | Bolleman et al. | 422/128 |
| 5,403,617 | A | | 4/1995 | Haaland | 427/180 |
| 5,411,208 | A | | 5/1995 | Burgener | 239/8 |
| 5,424,302 | A | | 6/1995 | Nitsch | 514/60 |
| 5,428,951 | A | * | 7/1995 | Wilson et al. | 431/1 |
| 5,429,302 | A | | 7/1995 | Abbott | 239/102.2 |
| 5,582,348 | A | | 12/1996 | Erickson | 239/4 |
| 5,758,823 | A | | 6/1998 | Glezer et al. | 239/4 |
| 5,791,601 | A | | 8/1998 | Dancila et al. | 244/207 |
| 5,800,153 | A | * | 9/1998 | DeRoche | 431/1 |
| 5,921,765 | A | * | 7/1999 | Smith | 431/1 |
| 5,957,413 | A | | 9/1999 | Glezer et al. | 244/208 |
| 6,092,990 | A | | 7/2000 | Hassan et al. | 416/42 |
| 6,234,751 | B1 | | 5/2001 | Hassan et al. | 416/42 |

* cited by examiner

10

18
24
28
32
36
40
42
44
46
48
50
30

COMBUSTION-DRIVEN JET ACTUATOR

CROSS-REFERENCE TO RELATED APPLICATION

The present application claims the benefit of the filing date of U.S. Provisional Patent Application Ser. No. 60/151,963, filed Sep. 1, 1999, this application hereby incorporated by reference into the present disclosure.

FIELD OF THE INVENTION

The present disclosure relates to combustion-driven jet actuators that can be used for flow control.

BACKGROUND OF THE INVENTION

Flow control is important in many aerodynamic and industrial applications. In recent years, attempts have been made to control flow through the use of fluidic devices such as jet actuators. It is hoped that use of such devices will one day yield advantageous results in various aerodynamic applications. For instance, it is anticipated that such devices could be used to increase lift, increase thrust, or reduce drag in aerodynamic vehicles. In addition, such devices may be used to manipulate internal flows through, for example, conduits and the like.

Although several different jet actuators have been developed or suggested, impediments still exist to their use in real world applications. One such impediment is the relatively low power generated by such devices. Jet actuators have been studied for years at low speeds, but little work has been conducted which would suggest that such devices could be used at high speeds due to the low power these actuators produce.

Another impediment to the implementation of jet actuators is the cost of their fabrication and/or operation relative to the cost savings they would provide in use. In other words, the complexity of the actuators should not be so great as to increase costs to the point where it is more costly to include and/or operate such devices despite the aerodynamic advantages they provide.

From the foregoing, it can be appreciated that it would be desirable to have an efficient, high power jet actuator of simple design with which flow can be controlled.

SUMMARY OF THE INVENTION

The present disclosure relates to a flow control system, comprising a controller, an ignition device whose activation is controlled by the controller, a combustion-driven jet actuator, and a fuel source in fluid communication with the jet actuator that supplies fuel to the jet actuator. Typically, the jet actuator comprises a combustion chamber, an orifice that serves as an outlet for combustion products emitted from the combustion chamber, and at least one inlet through which fuel is supplied to the chamber for combustion. In use, the combustion-driven jet actuator can emit jets of fluid at predetermined frequencies.

With the apparatus described above, flow can be controlled. Accordingly, the present disclosure further relates to a method for controlling flow, comprising providing a combustion-driven jet actuator having a combustion chamber, an orifice that serves as an outlet for combustion products emitted from the combustion chamber, and at least one inlet through which fuel is supplied to the chamber for combustion, and igniting the fuel within the combustion chamber to cause fluid jets to be emitted from the jet actuator which are used to control flow.

The features and advantages of the invention will become apparent upon reading the following specification, when taken in conjunction with the accompanying drawings.

BRIEF DESCRIPTION OF THE DRAWINGS

The invention can be better understood with reference to the following drawings. The components in the drawings are not necessarily to scale, emphasis instead being placed upon clearly illustrating the principles of the present invention.

DETAILED DESCRIPTION

Figure 1:
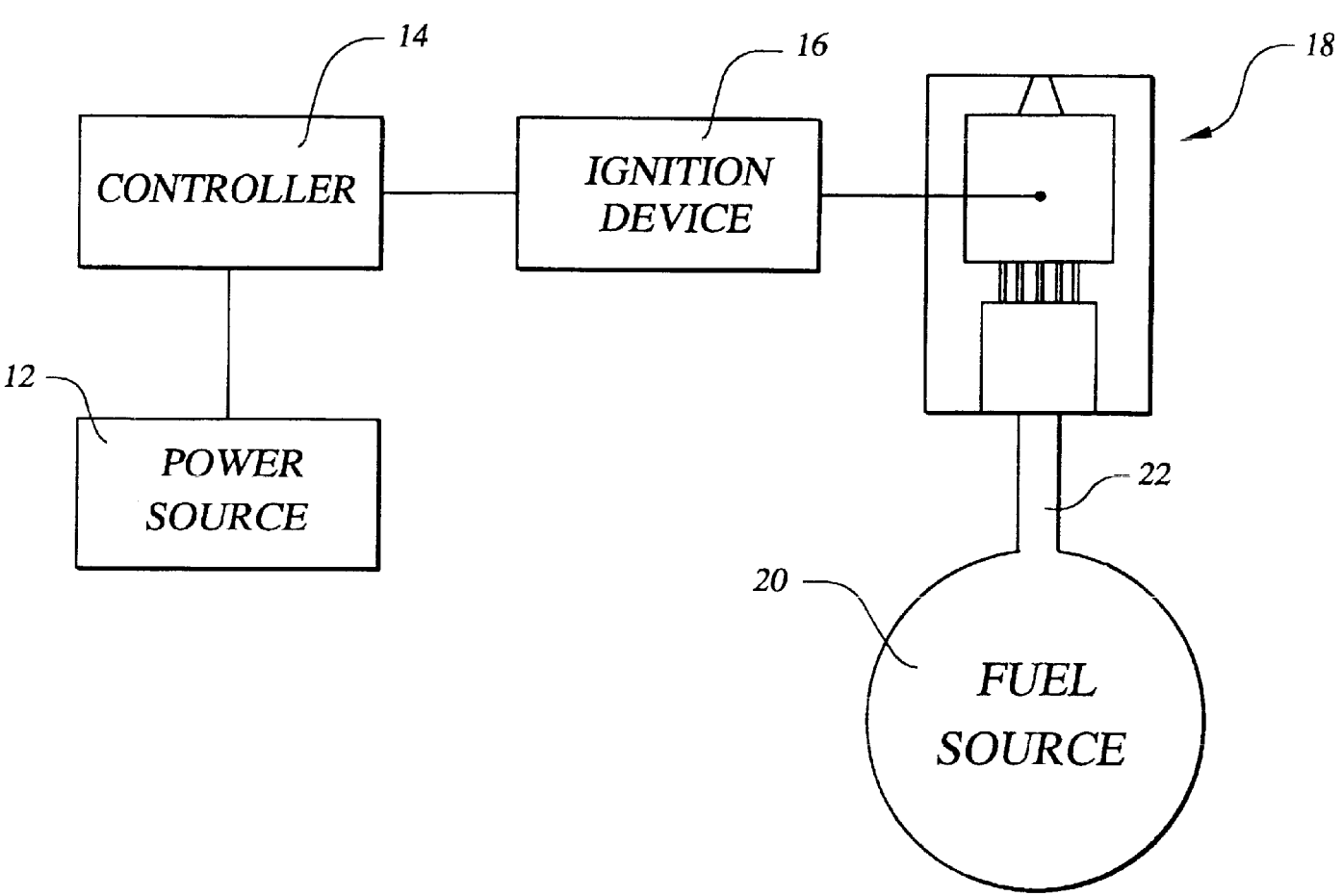
FIG. 1 is a schematic view of a flow control system of the present invention.

Referring now in more detail to the drawings, in which like numerals indicate corresponding parts throughout the several views, FIG. 1 illustrates a flow control system 10 of the present invention. As illustrated in FIG. 1, the flow control system 10 generally comprises a power source 12, a controller 14, an ignition device 16, a jet actuator 18, and a fuel source 20. By way of example, the power source 12 can comprise a direct current (DC) power source such as a battery. It is to be appreciated however that substantially any power source capable of supplying either direct current or alternating current (AC) power could be used depending upon the power needs of the controller 14 and the ignition device 16.

In a preferred arrangement, the controller 14 comprises a microprocessor (not shown) which is capable of executing commands that control the activation of the ignition device 16 at a desired frequency. As will be discussed in greater detail below, the jet actuator 18 is a combustion-based jet actuator capable of burning fuel in pulsed sequences to output high power jet pulses that can be used to control flow. Fuel is provided to the jet actuator 18 from a fuel source 20. In the arrangement shown in FIG. 1, the fuel source 20 comprises a reservoir containing a mixture of both a combustible fuel and an oxidizer such as air. This fuel/oxidizer mixture can be delivered to the jet actuator 18 with a fuel line 22.

Figure 2:
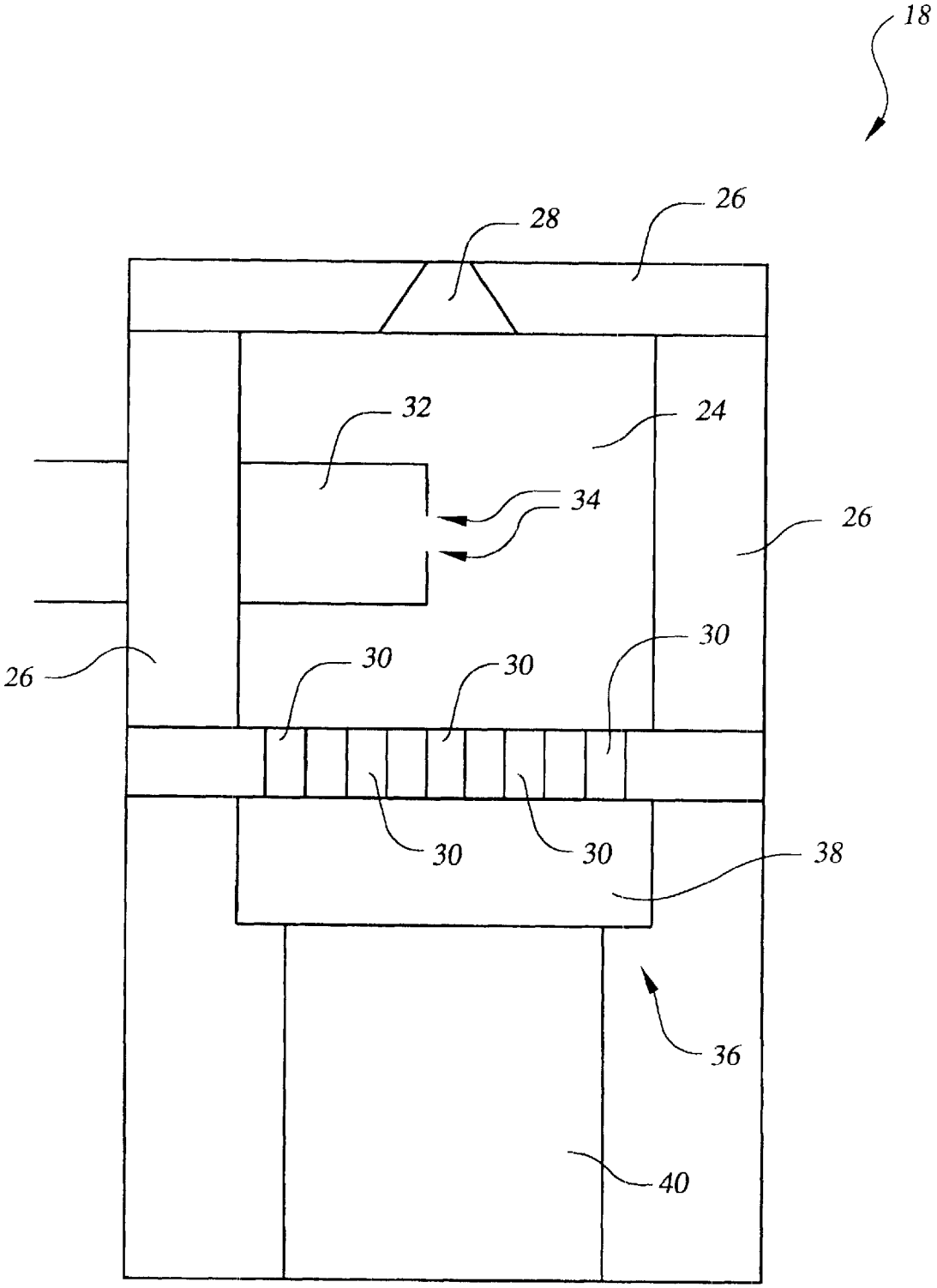
FIG. 2 is a schematic view of a jet actuator used in the system shown in FIG. 1.

FIG. 2 illustrates a preferred embodiment of a jet actuator 18 that can be used in the system of FIG. 1. By way of example, the actuator 18 can be manufactured with microelectromechanical systems (MEMS) technologies. Such technologies are particularly useful where the actuator 18 is extremely small in size. As indicated in FIG. 2, the jet actuator 18 comprises a combustion chamber 24 which is defined by a plurality of chamber walls 26. The walls 26 typically are constructed of a solid material that is highly resistant to heat and pressure. By way of example, the walls 26 can be constructed of a metal or ceramic material. Although the combustion chamber 24 can be of substantially any size, the chamber 24 preferably is relatively small in size, for instance having a volume of approximately 1 cubic centimeter (cc). As will be appreciated from the present disclosure, the smaller the volume of the chamber 24, the higher the frequency at which the jet actuator 18 can be operated. By way of example, the chamber 24 can be shaped as a cube or as a right cylinder. Preferably, however, the chamber 24 has a 1:1:1 dimension ratio to achieve high frequencies and pressures. It is to be understood, however, that other ratios can be used depending upon the desired results.

Formed at one end of the combustion chamber 24 is an orifice 28 which serves as an outlet for the jet actuator 18. Although only one such orifice 28 is illustrated in FIG. 2, it is to be understood that two or more such orifices can be provided, if desired. Preferably, the orifice 28 is tapered as indicated in FIG. 2 so as to form a nozzle with which the actuation jets can be emitted. By way of example, the orifice 28 can have a cross-sectional area of approximately 0.002 square inches at its exit end.

Formed at another end of the combustion chamber 24 is a plurality of inlets 30 which deliver the fuel/oxidizer mixture to the combustion chamber 24. Although the inlets 30 are illustrated as being positioned opposite the orifice 28, it will be appreciated that alternative configurations are possible. In one arrangement, the inlets 30 can be formed in an orifice plate for ease of construction. Alternatively, each inlet 30 can comprise an inlet tube or other passageway through which the fuel/oxidizer mixture can travel into the combustion chamber 24. The number and size of the inlets 30 typically vary depending upon the particular application of the jet actuator 18 and the results desired. However, by way of example, five inlets 30 each having a cross-sectional area of approximately 0.0005 square inches can be provided. Although inlets 30 having circular cross-sections are presently contemplated, it is to be understood that alternative cross-sectional configurations are possible.

Disposed within the combustion chamber 24 is a spark generating device such as a set of are electrodes 32 which is used to deliver ignition sparks to the fuel/oxidizer mixture within the chamber 24. These electrodes 32 create such sparks intermittently at particular frequencies in response to activation of the ignition device 16 illustrated in FIG. 1. Although only one set of electrodes are shown in FIG. 2, multiple electrode sets could be provided to produce multiple sparks, if desired. By way of example, the ignition device 16 can comprise an electrical generator which supplies the electrodes 32 with enough current to create an arc that forms across the tips 34 of the electrodes 32.

In a preferred embodiment, sintered material 36 can be placed within the flow path leading to the chamber 24. By way of example, this material can be positioned directly upstream of the inlets 30 in the form of a block 38 of sintered material 36. Normally, the sintered material 36 comprises a metal material such as copper or stainless steel. Use of this sintered material 36 is preferable in that it provides a high degree of uniformity to the fuel/oxidizer flow as it passes to the combustion chamber 24 and filters small particulate matters from the flow. In addition, use of such a sintered material permits easy manipulation of the pressure drop in the flow across the inlet of the combustion chamber 34. As discussed below, control of this pressure drop is important in obtaining the desired timing in the combustion cycle. The greater the thickness and/or density of the sintered material 36, the greater the fuel/oxidizer pressure drop across the inlet of the chamber 24. By way of example, the block 35 can have a thickness of approximately 2 millimeters (mm) in the axial direction of the actuator 18 and can include passages no greater than 2 microns ($\mu$m) in size. Upstream from the sintered material 34 is a passageway 40 through which the fluid/oxidizer mixture can travel within the actuator 18.

Figures 3A, 3B, 3C:
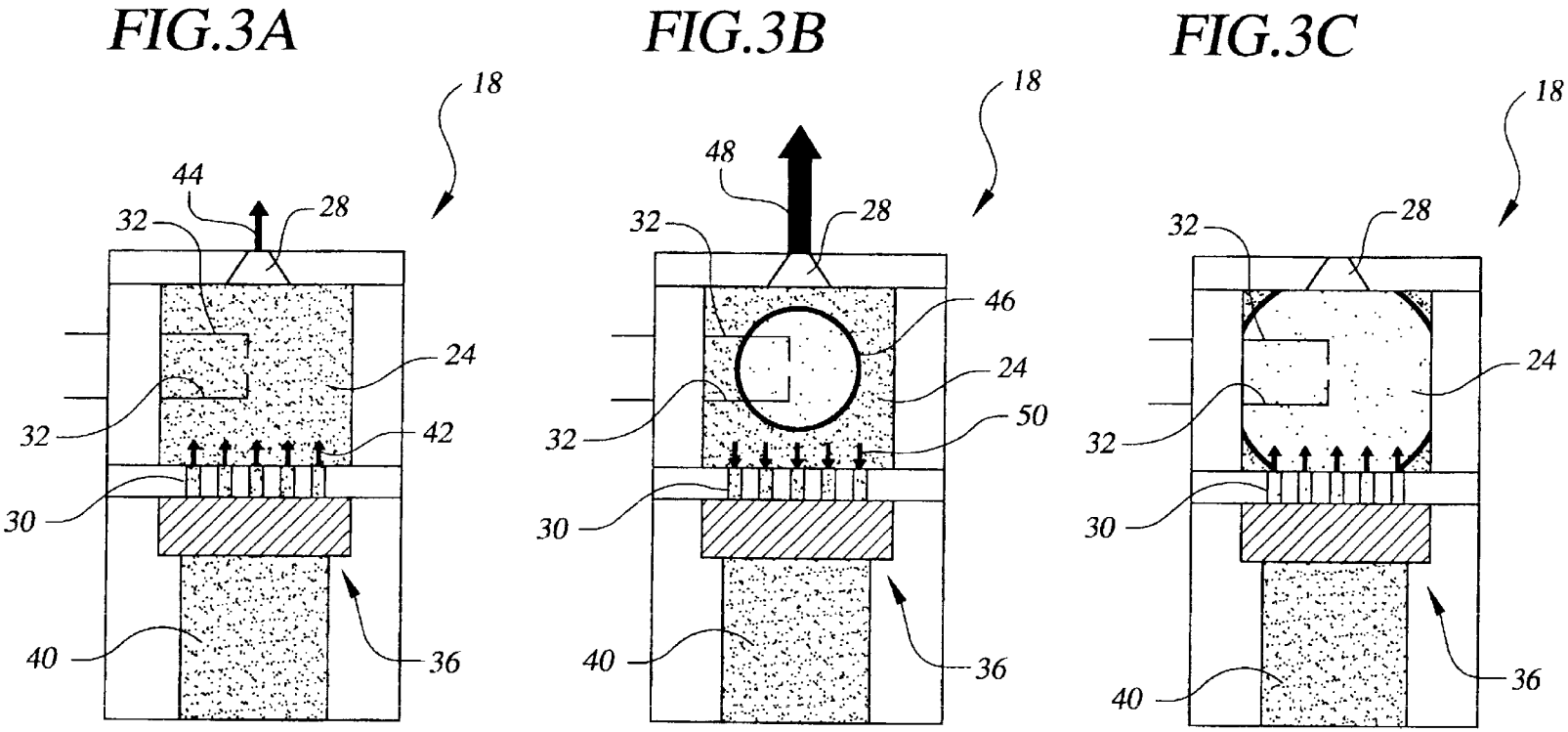
FIGS. 3A–3C illustrate various stages of a combustion cycle of the actuator shown in FIG. 2.

Operation of the fluid control system 10 generally and the jet actuator 18 in particular will be described with reference to FIGS. 3A–3C. These figures illustrate various stages of the combustion cycle that the jet actuator 18 undergoes in operation. FIG. 3A illustrates the filling (or refilling) stage of the cycle. As indicated in this figure, the fuel/oxidizer mixture flows through the actuator passageway 40, the sintered material 36, and into the various inlets 30 such that the fuel/oxidizer mixture can be introduced into the chamber 24 as indicated with arrows 42. Normally, the flow of fuel/oxidizer mixture into the chamber 24 is not actively controlled such that the mixture is permitted to continually flow into the chamber 24 without mechanical regulation. Normally, the mixture is provided to the actuator at a relatively high pressure, e.g., 10 pounds per square inch (psig), to ensure an uninterrupted supply. Although such an arrangement is preferred due to its simplicity, it will be appreciated that a valve mechanism (not shown) could be used to regulate flow to the combustion chamber 24, if desired (see FIG. 9).

Although the fuel/oxidizer mixture can take many different forms, the mixture preferably comprises an easily combustible fuel such as a hydrocarbon fuel. Examples of suitable hydrocarbon fuels include propane, butane, methane, acetylene, and the like. Alternatively, a non-hydrocarbon fuel such as hydrogen can be used. As is known in the art, the aforementioned fuels can be stored in liquid form at high pressure and later expanded into gas form for mixing with the oxidizer. Normally, stoichiometric mixtures are used to provide the fastest burn times and highest frequencies and pressure. Although FIG. 1 indicates an embodiment in which the fuel and oxidizer are premixed, it is to be understood that the fuel and oxidizer can be supplied from separate sources and later mixed prior to entry into the combustion chamber 24. In another arrangement, the fuel and oxidizer can be introduced into the combustion chamber 24 through separate supply lines (see FIG. 10). In such an arrangement, however, additional time is required during the combustion cycle for mixing of the fuel and oxidizer within the combustion chamber 24. This additional time lengthens the combustion cycle and therefore limits the frequency with which the jet actuator can be operated.

Figure 4A:
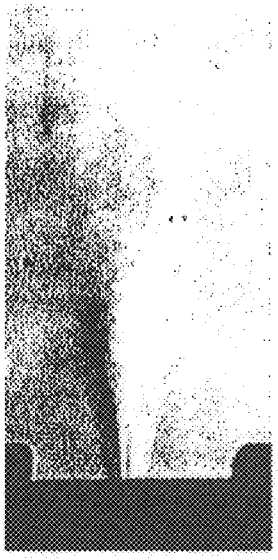
FIGS. 4A–4C are images of various stages of a jet produced by the actuator during strong combustion.
Figure 4B:
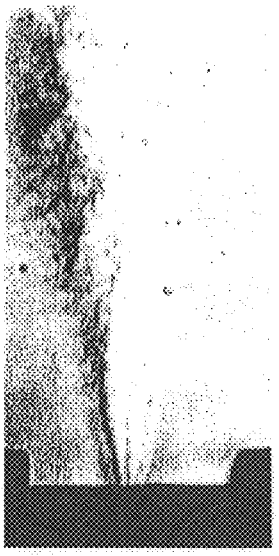
Figure 4C:
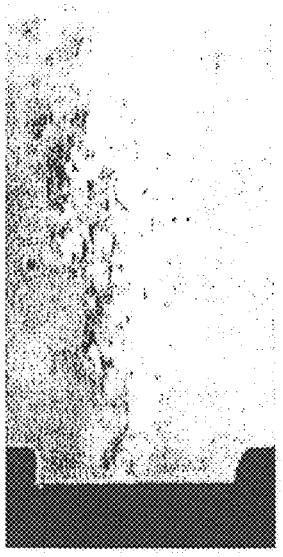

As the fuel/oxidizer mixture enters the combustion chamber 24, the combustion products remaining from the previous combustion cycle are exhausted through the orifice 28 as indicated by the small arrow 44 in FIG. 3A. Once the combustion chamber 24 has been filled with an appropriate amount of the fuel/oxidizer mixture, an appropriate current is supplied by the ignition device 16 (FIG. 1) to the electrodes 32 to create a spark within the chamber 24 as indicated in FIG. 3B. This spark ignites the fuel/oxidizer mixture and initiates the strong combustion stage of the combustion cycle. This strong combustion creates a combustion burst 46 which lasts several milliseconds, raising the pressure within the chamber 24 to several atmospheres. This pressure increase creates a fluidic jet 48 that is propelled at high speed from the orifice 28 as indicated in FIG. 3B. FIGS. 4A–4C are Schlieren images of such a jet of fluid emitted from a jet actuator similar to that illustrated in FIGS. 3A–3C operating at a frequency of 60 Hz.

Simultaneous with combustion, the high pressure in the chamber 24 creates a back flow indicated by arrows 50 of combustion products into the inlets 30 as indicated in FIG. 3B. The inlets 30 are designed so as to be small enough to quench the flames and prevent them from propagating backwards to the fuel source 20. The backward propagation of the combustion products is desirable to the actuation timing of the actuator 18. After ignition, the combustion products fill the inlets 30 and the sintered material 36 and act as a buffer that temporarily interrupts the flow of fuel/oxidizer into the combustion chamber 24. This interruption of flow permits weak combustion of any remaining fuel/oxidizer within the chamber 24, as indicated in FIG. 3C, and permits the chamber 24 to cool. This back flow therefore creates a time delay that allows the combustion process to extinguish before new fuel/oxidizer mixture again enters the chamber 24. Without this time delay, the new mixture entering the chamber 24 would immediately ignite (i.e., preignite) as a result of the remaining combustion and/or due to spontaneous combustion, and a continuous flaming jet would be output at the orifice 28. Instead, however, the delay allows the combustion cycle to begin again with refilling of the combustion chamber 24 as discussed above with reference to FIG. 3A. The extent to which the combustion products flow back through the inlets 30 of the actuator 18 can be controlled by tailoring the pressure drop across the chamber inlet so that it is larger than the pressure drop across the chamber outlet (i.e., orifice 28). With such a configuration, it is ensured that the bulk of products are emitted from the actuator 18 as a jet 48 and that the time delay is of the desired duration.

Operating in this manner, the frequency of actuation of the jet actuator 18 can be controlled through manipulation of the frequency with which the spark is delivered to the combustion chamber 24 and the speed with which the chamber 24 is filled and emptied. As will be appreciated by persons having ordinary skill in the art, the refilling/emptying rate is dependent in large part upon the absolute and relative sizes of the actuator chamber 24, orifice 28, and the inlets 30. When the appropriate relative dimensions are used, the combustion cycle automatically regulates injection of the mixture at the desired frequency. By way of example, this cycle will have a duration of approximately 1 to 5 milliseconds (ms) which permits frequencies in excess of 250 hertz (Hz). Due to the absence of moving parts, the jet actuator 18 is very simple in construction and its fabrication can be easily repeated. Despite the continuous flow of fuel/oxidizer to the jet actuator 18, fuel consumption is relatively small due to the relatively small dimensions of the actuator 18. Indeed, where jet actuators 18 are used to control flow over a surface of a relatively large vehicle such as an airplane, this fuel consumption is relatively negligible. In such an application, both fuel and air can be drawn from the engine (s) of the airplane such that a separate fuel/oxidizer source is unnecessary.

Figure 5:
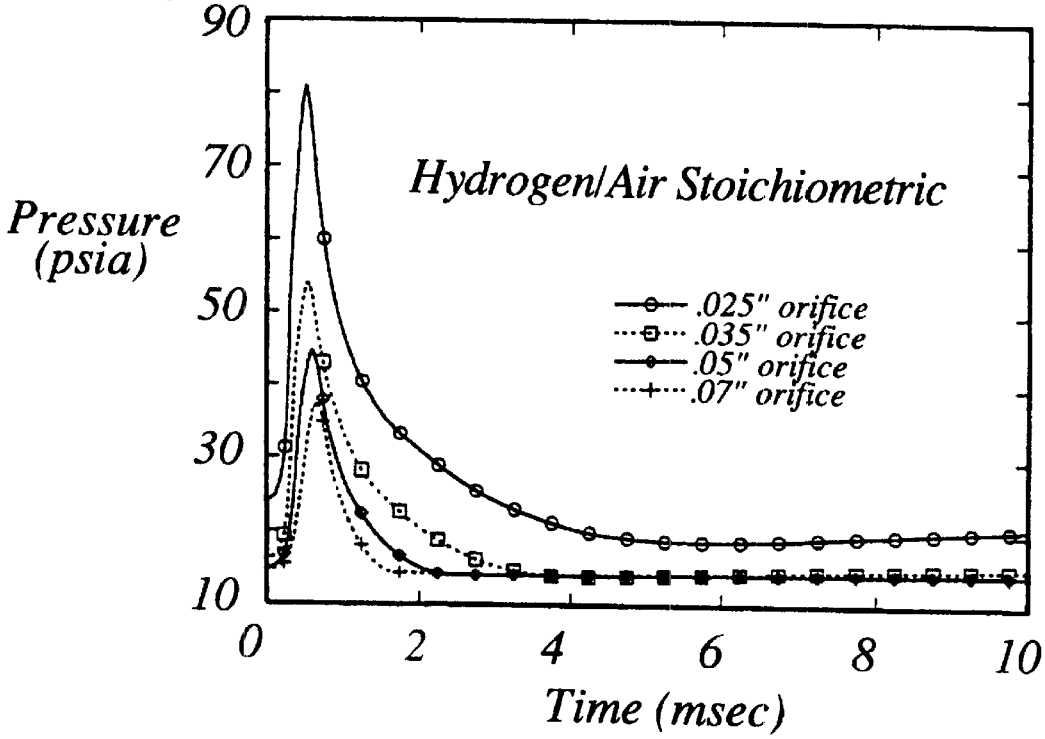
FIG. 5 is a plot of pressure versus time within a jet actuator burning hydrogen fuel and having various orifice dimensions.
Figure 6:
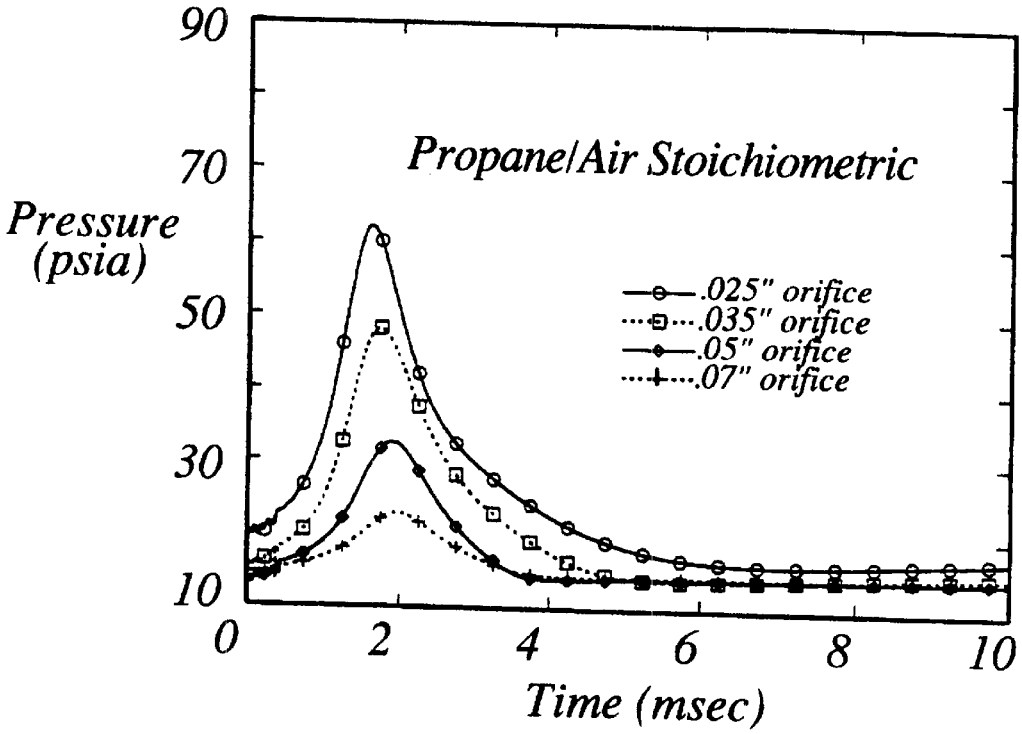
FIG. 6 is a plot of pressure versus time within a jet actuator burning propane fuel and having various orifice dimensions.
Figure 7:
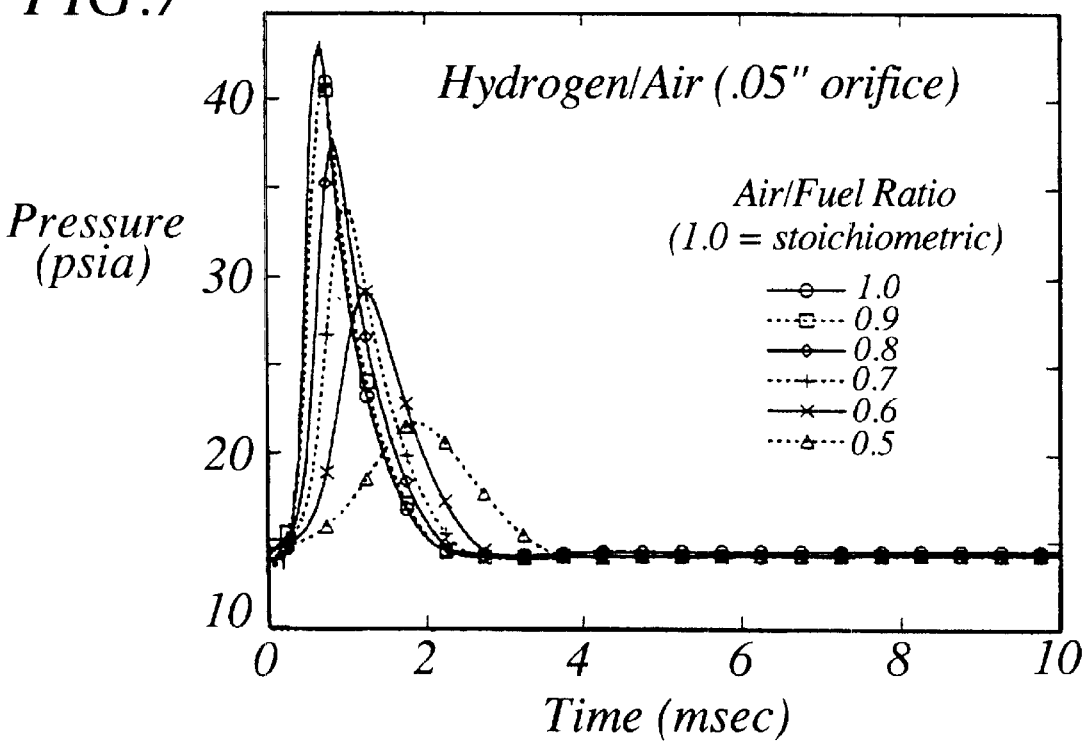
FIG. 7 is a plot of pressure versus time within a jet actuator burning hydrogen fuel at various air/fuel ratios.
Figure 8:
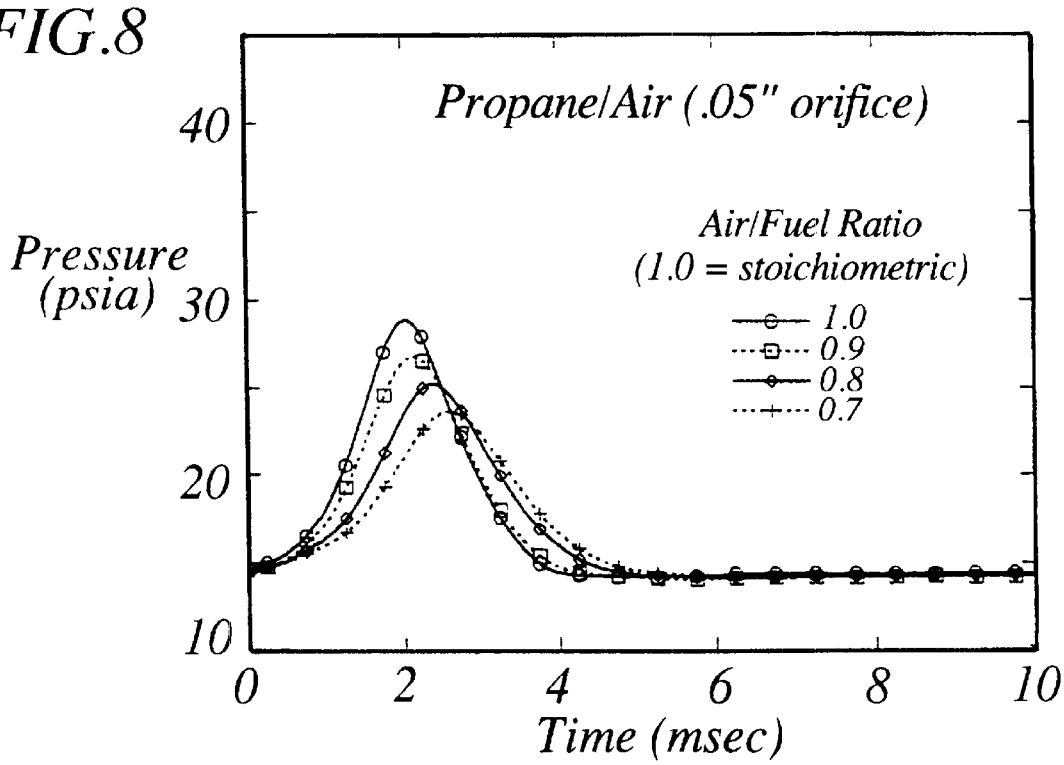
FIG. 8 is a plot of pressure versus time within a jet actuator burning propane fuel at various air/fuel ratios.

Through use of a combustion-based actuator 18, effective flow control can be achieved even at high speeds due to the high power produced by each actuator 18. This high power generation is possible because of the high energy density of combustible fuels. In particular, use of such fuels results in an amplified response in that a much greater energy output is obtained as compared to the amount of energy input. Accordingly, the jet actuator 18 can be considered a chemical amplifier which converts relatively small amounts of chemical energy into relatively large amounts of fluidic energy. The relatively high power achievable with the jet actuator 18 can be appreciated with reference to FIGS. 5–8. FIGS. 5 and 6 are plots of pressure versus time within jet actuators burning hydrogen and propane fuels, respectively, and having various sized orifices. As indicated in these figures, pressures as high as 85 pounds per square inch (psia) are achievable within the combustion chamber 24. FIGS. 7 and 8 plot pressure versus time in actuators burning hydrogen and propane fuels having various air/fuel ratios. As indicated in these figures, pressures as high as approximately 43 psia are achievable. With these high pressures, supersonic jets can be obtained. By way of example, jets can be emitted in excess of 340 meters per second (mps). It is to be noted that, although particular values are identified in FIGS. 5–8 and above, system parameters (e.g., orifice size, chamber size, fuel/oxidizer mixtures, etc.) can be varied to specifically tailor the pressure curves and resulting jets to obtain the desired output whether it be strong, fast jets or weaker, longer lasting jets.

Figure 9:
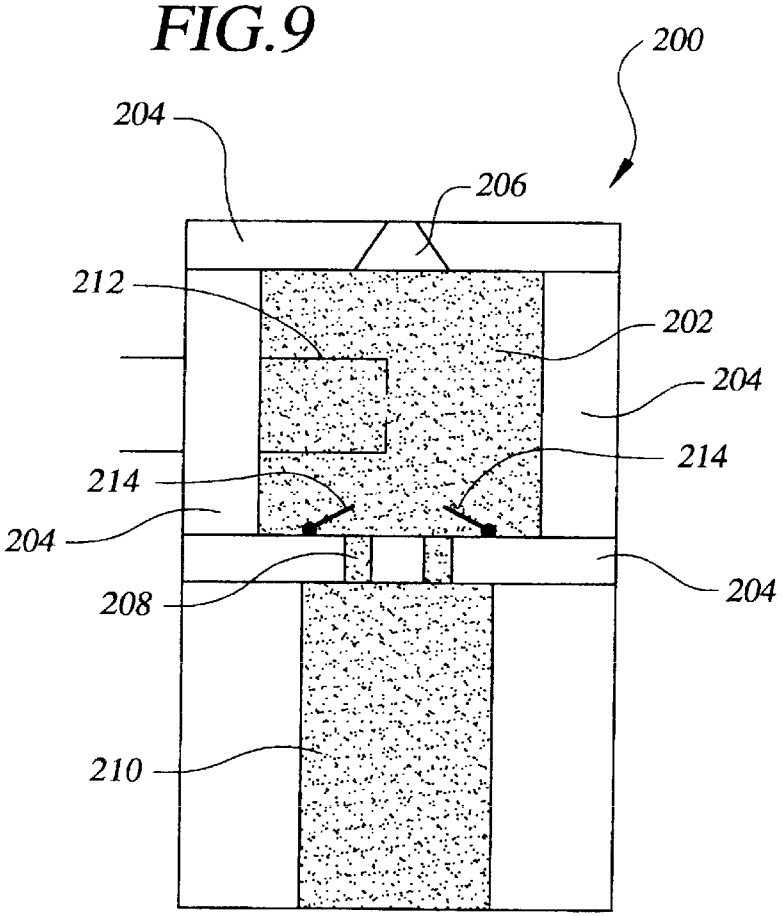
FIG. 9 is a schematic view of a first alternative jet actuator of the present invention.

FIG. 9 illustrates a first alternative embodiment of a jet actuator 200 constructed in accordance with the present invention. The jet actuator 200 is similar in design to the jet actuator 18 described with reference to FIG. 2. Accordingly, the actuator 200 includes a combustion chamber 202 formed by a plurality of chamber walls 204. Formed at one end of the chamber 202 is an orifice 206 that serves as an outlet for exhaust gases. Also provided in one of the walls are inlets 208 which deliver fuel/oxidizer from a passageway 210 provided in the actuator 200 to the combustion chamber 202. In addition, the jet actuator 200 includes electrodes 212 which are used to provide sparks within the combustion chamber 202 that ignite the fuel/oxidizer mixture therein. As schematically identified in FIG. 9, however, the jet actuator 200 further includes fuel valves 214 which can be used to permit or interrupt the flow of the fuel/oxidizer mixture from the inlets 208 to the combustion chamber 202. As will be appreciated by persons having ordinary skill in the art, these valves 214 can be formed as by micromachining. In use, the jet actuator 200 operates in similar manner to the jet actuator 18. However, the jet actuator 200 relies upon the frequency with which a spark is provided within the chamber 202 and the timing with which the valves 214 are operated to control the actuation frequency of the device. Accordingly, the valves 214 are opened during the refilling stage of the combustion cycle and are closed prior to the ignition stage of the cycle and during strong and weak combustion within the chamber 202. With this arrangement, the relative dimensionality of the chamber 202, orifice 206, and inlets 208 need not be relied upon to control the flow of fuel/oxidizer to the chamber 202.

Figure 10:
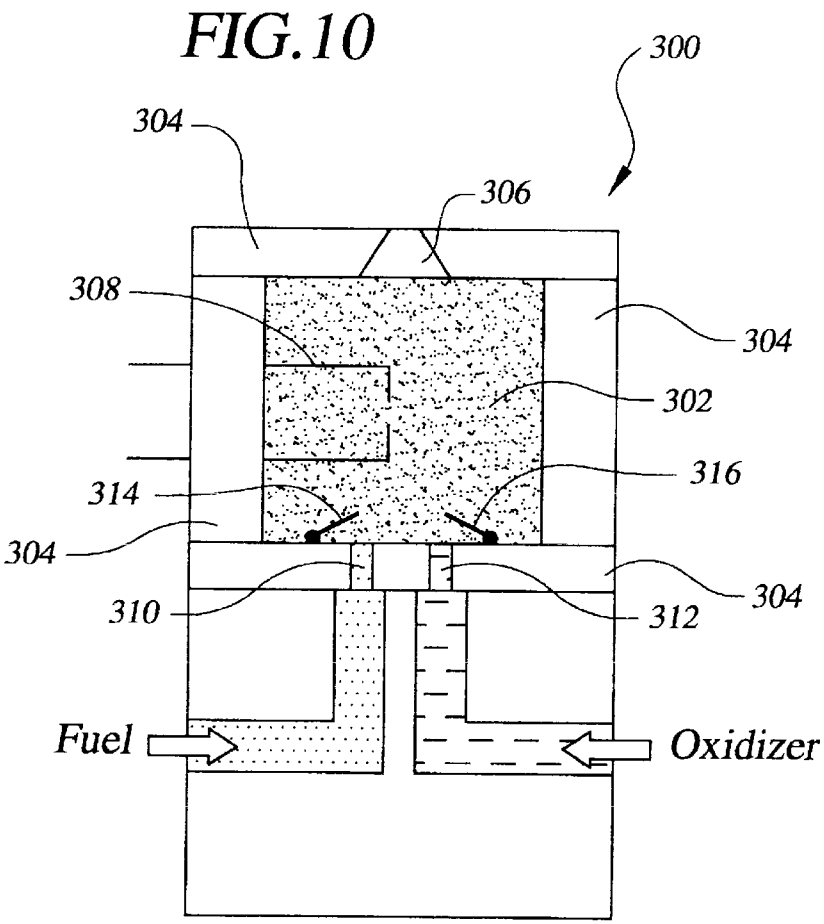
FIG. 10 is a schematic view of a second alternative jet actuator of the present invention.

FIG. 10 illustrates a second alternative embodiment of a jet actuator 300. This actuator 300 is similar in design to the actuator 200 and therefore comprises a combustion chamber 302, chamber walls 304, an orifice 306, and electrodes 308. However, the jet actuator 300 is provided with fuel and oxidizer through separate inlets 310 and 312. Optionally, each of these inlets 310, 312 can be provided with its own valve 314 and 316, respectively. In operation, the combustion chamber 302 is provided with separate flows of fuel and oxidizer such that the combustion cycle includes a mixing stage. Although the mixing stage lengthens the duration of the combustion cycle, and therefore lowers the frequency with which the actuator 300 can be actuated, the embodiment shown in FIG. 10 might be desirable in situations in which a particularly high actuation frequencies are not needed.

Figure 11:
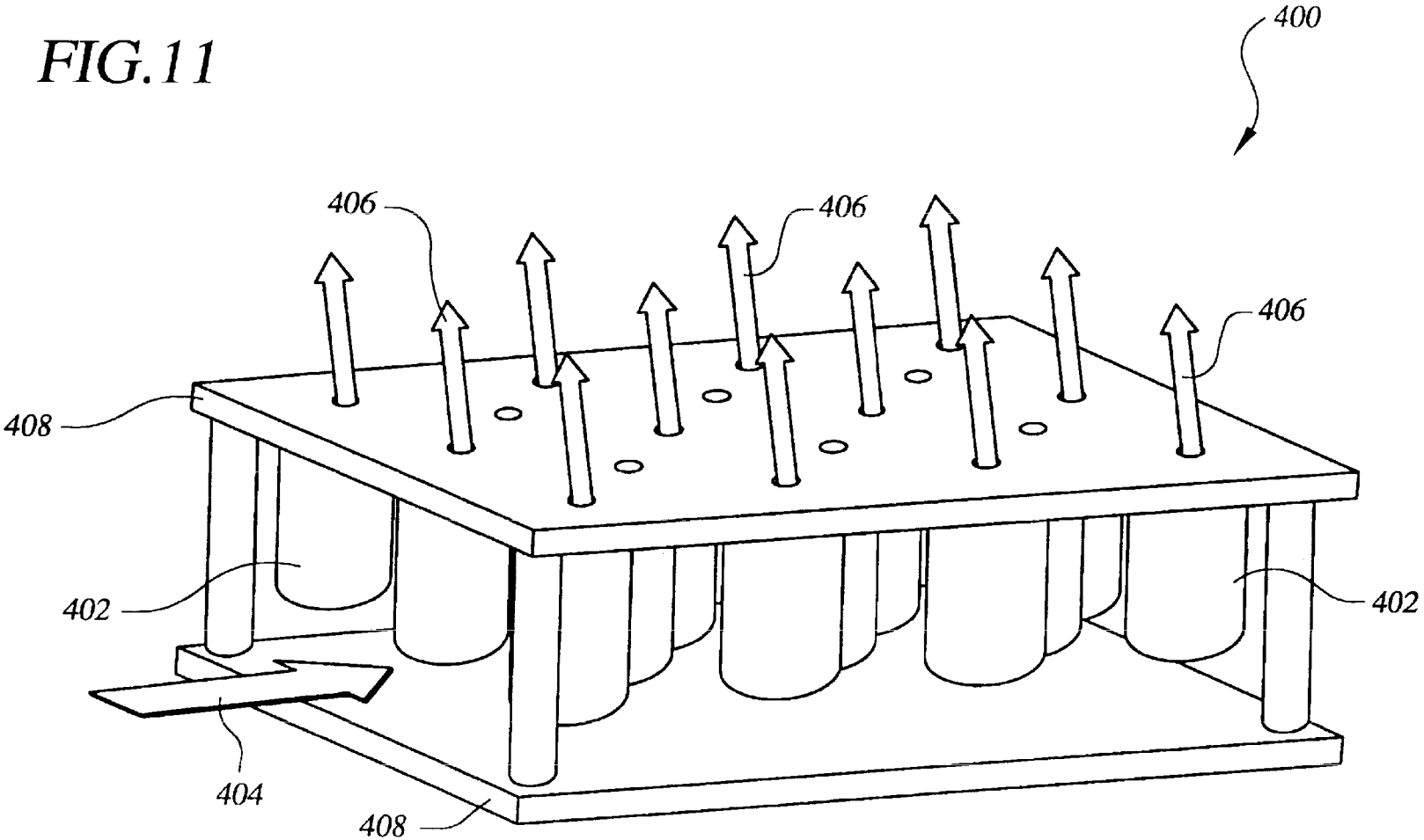
FIG. 11 is a schematic view of an array of jet actuators.

FIG. 11 illustrates an array 400 of jet actuators 402 that can be used to effect flow control in a localized area. By way of example, each of the jet actuators 402 can be supplied with a flow 404 of fuel/oxidizer which enters the actuators 402 from their bases. Due to the simple construction of the jet actuators 402, and the repeatability achievable due to the simplicity, actuation jets 406 of similar magnitude firing with the substantially same frequency can be obtained. Alternatively, the jet actuators 402 can be individually controlled such that the jet actuators 402 fire in predetermined sequences to alter the frequency at which jets are emitted in a particular localized area. Operating in this manner, the frequency of jet emission can be multiplied to yield an artificially high frequency output where very high jet frequencies are desired. Due to the small size of the jet actuators described herein, it is anticipated that jet actuator arrays such as that illustrated in FIG. 11 can be formed, for instance, in sheets 408 of pliable material which can be applied to a surface such as an airfoil. In such an arrangement, the pliability of the jet actuator array 400 provides for extremely high conformability, even to curved surfaces. In an alternative arrangement, each of the actuators 402 of the array 400 can emit their jets into a chamber (not shown) having its own outlet such that a predetermined sequence of jets can be emitted from a single outlet.

While particular embodiments of the invention have been disclosed in detail in the foregoing description and drawings for purposes of example, it will be understood by those skilled in the art that variations and modifications thereof can be made without departing from the scope of the invention as set forth in the following claims. As will be appreciated by persons having ordinary skill in the art, the applications for the jet actuators described herein are manifold. In addition to purely aerodynamic applications including vehicle propulsion, the prevention of flow separation, the creation of virtual surfaces, and circulation control, many industrial applications exist for internal flow control. For example, the actuators can be used to create virtual constrictions within conduits, to form shock waves, and so forth. Furthermore, the actuators can be used in separate devices such as drivers for these devices (e.g., piston actuation). All such applications are presently contemplated and are intended to be within the scope of the present invention.

What is claimed is:

1. A system for modifying a high speed fluid flow, comprising:

an aerodynamic surface adjacent or within the high speed fluid flow; and a deflagration combustion-driver jet actuator provided on the aerodynamic surface, the jet actuator including a combustion chamber, a spark generating device that supplies ignition sparks within the combustion chamber to ignite fuel, an orifice that serves as an outlet for combustion products emitted from the combustion chamber, and at least one inlet through which fuel is supplied to the chamber for combustion, wherein the combustion frequency of the jet actuator is controllable with the spark generation device so that the jet actuator can emit jets of fluid at various different frequencies;

wherein actuation of the jet actuator causes a jet to be emitted that modifies the high speed fluid flow.

2. The jet actuator of claim 1, wherein the spark generating device comprises electrodes disposed within the chamber.

3. The jet actuator of claim 1, wherein the jet actuator does not include valves that control the flow of fuel to the combustion chamber and the supply of fuel to the chamber is regulated by the combustion cycle.

4. The jet actuator of claim 1, wherein the jet actuator includes at least one valve that controls the flow of fuel to the combustion chamber.

5. The jet actuator of claim 1, further comprising sintered material provided along a flowpath leading to the combustion chamber.

6. The jet actuator of claim 5, wherein the sintered material is positioned directly upstream from the at least one inlet.

7. The jet actuator of claim 5, wherein the sintered material is formed as a block of sintered material.

8. The jet actuator of claim 1, wherein the at least one inlet is formed in an orifice plate.

9. The jet actuator of claim 1, wherein combustion chamber has a volume of approximately 1 cubic centimeter.

10. The system of claim 1, wherein the aerodynamic surface comprises a surface of an airfoil.

11. The system of claim 1, wherein the aerodynamic surface comprises a surface of a conduit.

12. The system of claim 1, wherein the aerodynamic surface is curved.

13. A flow control system for modifying a high speed fluid flow, comprising:

an ignition device;

a deflagration combustion-driven jet actuator including a combustion chamber, an orifice that serves as an outlet for combustion products emitted from the combustion chamber, and at least one inlet through which fuel is supplied to the chamber for combustion;

a fuel source in fluid communication with the jet actuator that supplies fuel to the jet actuator;

a controller that is configured to control the frequency of activation of the ignition device so as to control the frequency of combustion of fuel in the jet actuator; and an aerodynamic surface on which the jet actuator is positioned, the aerodynamic surface being positioned within or adjacent the high speed fluid flow;

wherein actuation of the jet actuator causes a jet to be emitted that modifies the high speed fluid flow.

14. The system of claim 13, wherein the jet actuator comprises a combustion chamber, an orifice that serves as an outlet for combustion products emitted from the combustion chamber, and at least one inlet through which fuel is supplied to the chamber for combustion.

15. The system of claim 14, wherein the jet actuator further comprises a spark generating device that supplies ignition sparks within the combustion chamber to ignite the fuel.

16. The system of claim 15, wherein the spark generating device comprises electrodes disposed within the chamber.

17. The system of claim 14, wherein the jet actuator does not include valves that control the flow of fuel to the combustion chamber and the supply of fuel to the chamber is regulated by the combustion cycle.

18. The system of claim 14, wherein the jet actuator includes at least one valve that controls the flow of fuel to the combustion chamber.

19. The system of claim 14, wherein the jet actuator further comprises sintered material provided along a flowpath leading to the combustion chamber.

20. The system of claim 19, wherein the sintered material is positioned directly upstream from the at least one inlet.

21. The system of claim 13, wherein the controller comprises a microprocessor.

22. The system of claim 13, wherein the ignition device comprises an electrical generator.

23. The flow control system of claim 13, wherein the combustion chamber of the jet actuator has a volume of approximately 1 cubic centimeter.

24. A flow control device for modifying a high speed fluid flow, comprising:

a plurality of deflagration combustion-driven jet actuators provided in an array;

wherein each of said jet actuators comprises a combustion chamber, an orifice that serves as an outlet for combustion products emitted from the combustion chamber, and at least one inlet through which fuel is supplied to the chamber for combustion, wherein each jet actuator orifice is independently exposed to the high speed fluid flow so as to be capable of separately affecting the fluid flow.

25. The device of claim 24, wherein each jet actuator further comprises a spark generating device that is configured to supply ignition sparks within its combustion chamber to ignite the fuel at various different frequencies.

26. The device of claim 24, wherein the spark generating device of each jet actuator comprises electrodes disposed within the chambers.

27. The device of claim 24, wherein none of the jet actuators include valves that control the flow of fuel to the combustion chamber and the supply of fuel to the chamber is regulated by the combustion cycles of the actuators.

28. The device of claim 24, wherein each jet actuator includes at least one valve that controls the flow of fuel to the combustion chambers.

29. The device of claim 24, wherein each jet actuator further comprises sintered material provided along a flowpath leading to its combustion chamber.

30. The device of claim 24, wherein the sintered material is positioned directly upstream from the at least one inlet in each jet actuator.

31. The device of claim 24, wherein the array of jet actuators is provided in a conformable member made of a pliable material such that the device can be applied to nonplanar surfaces.

32. The flow control device of claim 24, wherein the combustion chamber of the jet actuator has a volume of approximately 1 cubic centimeter.

33. A method for controlling flow, comprising:

providing a deflagration combustion-based jet actuator in an aerodynamic surface within or adjacent a high speed fluid flow, the jet actuator having a combustion chamber, an orifice that serves as an outlet for combustion products emitted from the combustion chamber, and at least one inlet through which fuel is supplied to the chamber for combustion, the jet actuator not including an exhaust pipe; and modifying the high speed fluid flow by periodically igniting the fuel at a desired frequency within the combustion chamber to cause fluid jets to be emitted from the jet actuator at a particular frequency to control the fluid flow.

34. The method of claim 33, wherein the pressure drop across the inlet to the chamber is greater than that across the outlet of the chamber.

35. The method of claim 33, wherein combustion products flow back into the at least one inlet to a predetermined extent after the fuel is ignited within the combustion chamber.

36. The method of claim 35, wherein the back flow of combustion materials temporarily interrupts the flow of fuel to the combustion chamber to provide a time delay in the combustion cycle.

37. The method of claim 33, further comprising providing a plurality of jet actuators in an array to control flow in a localized area.

38. The method of claim 37, wherein the frequency of actuation of each jet actuator is individually controlled.

39. The method of claim 33, wherein the jets of fluid are emitted from the jet actuator at supersonic speeds.

40. The method of claim 33, wherein the combustion chamber of the jet actuator has a volume of approximately 1 cubic centimeter.

41. A system for modifying a high speed fluid flow, comprising:

a deflagration combustion-driver jet actuator including a combustion chamber, a spark generating device that supplies ignition sparks within the combustion chamber to ignite fuel, an orifice that serves as an outlet for combustion products emitted from the combustion chamber, at least one inlet through which fuel is supplied to the chamber for combustion, and sintered material positioned directly upstream from the at least one inlet, wherein the combustion frequency of the jet actuator is controllable with the spark generation device so that the jet actuator can emit jets of fluid at various different frequencies; and an aerodynamic surface on which the jet actuator is positioned, the aerodynamic surface being in or adjacent the high speed fluid flow;

wherein actuation of the jet actuator causes a jet to be emitted that modifies the high speed fluid flow.

42. The system of claim 41, wherein the sintered material of the jet actuator is formed as a block of sintered material.

43. The system of claim 41, wherein the at least one inlet of the jet actuator is formed in an orifice plate.

* * * * *